US007723632B2

(12) United States Patent
Wong

(10) Patent No.: US 7,723,632 B2
(45) Date of Patent: May 25, 2010

(54) ELECTRICAL SWITCH

(75) Inventor: Kin Yu Wong, Hong Kong SAR (CN)

(73) Assignee: Defond Components Limited, Chaiwan, Hong Kong SAR (CN)

( * ) Notice: Subject to any disclaimer, the term of this patent is extended or adjusted under 35 U.S.C. 154(b) by 286 days.

(21) Appl. No.: 11/741,825

(22) Filed: Apr. 30, 2007

(65) Prior Publication Data

US 2008/0264769 A1 Oct. 30, 2008

(51) Int. Cl.
*H01H 13/30* (2006.01)

(52) U.S. Cl. ..... 200/522; 200/534; 200/243

(58) Field of Classification Search ..... 200/4, 200/522, 534–538, 240–250, 434, 435, 447
See application file for complete search history.

(56) References Cited

U.S. PATENT DOCUMENTS 6,710,277 B1 3/2004 Wong
6,784,390 B2 * 8/2004 Chu ..... 200/522
6,791,038 B1 9/2004 Lai
7,186,940 B1 3/2007 Wong
2008/0156627 A1 7/2008 Wong

* cited by examiner

*Primary Examiner*—Renee S Luebke
*Assistant Examiner*—Marina Fishman
(74) *Attorney, Agent, or Firm*—Leydig, Voit & Mayer, Ltd.

(57) ABSTRACT

An electrical switch has two fixed contacts and a moving contact, a spring urging the moving contact towards contacting the fixed contacts, and an actuating mechanism for moving the moving contact away from the fixed contacts against urging by the spring and, alternatively, allowing the moving contact to contact the fixed contacts under the action of the spring. The actuating mechanism has an engaging member for engaging and retaining the moving contact and includes a spring acting on the engaging member for separating the moving contact from the fixed contacts through an instant spring-release action. One of the engaging member and the contacts is configured such that the moving contact will be engaged and moved by the engaging member out of contact with one of the fixed contacts earlier than with the other fixed contact.

13 Claims, 4 Drawing Sheets

ELECTRICAL SWITCH

The present invention relates to an electrical switch.

BACKGROUND OF THE INVENTION

An electrical switch of the kind concerned typically has a casing, two fixed contacts, and a moving contact which is resiliently biased towards contacting the fixed contacts, whereby the switch is closed. A spring-loaded actuator is used to bring about movement of the moving contact relative to the fixed contacts, and in particular to move the moving contact out of contact from the fixed contacts for opening the switch.

During opening of the switch, it is unpredictable as to which one of the fixed contacts the moving contact is to leave last. This is a concern in the design of heavy-current switches as arcing and/or flashover often occur at where the circuit is opened i.e. across the moving contact and the fixed contact it departs last. Of course, both fixed contacts together with the moving contact can be enhanced for better performance, for example made larger and/or coated with platinum, but production cost will escalate. Another consideration is the speed at which the moving contact is separated from the fixed contacts.

The invention seeks to provide an improved electrical switch of this type in general.

SUMMARY OF THE INVENTION

According to the invention, there is provided an electrical switch comprising a casing, two fixed contacts and a moving contact in the casing, a first spring resiliently biasing the moving contact towards contacting the fixed contacts to thereby close the switch, and an actuating mechanism for causing movement of the moving contact relative to the fixed contacts. The actuating mechanism is operable between a first operating condition in which the moving contact is moved out of contact from the fixed contacts against the action of the first spring and a second operating condition in which the moving contact is allowed to come into contact with the fixed contacts under the action of the first spring. The actuating mechanism has an engaging member for engaging and retaining the moving contact from contacting the fixed contacts in the first operating condition and includes a second spring acting on the engaging member for moving the moving contact out of contact from the fixed contacts through an instant spring-release action. At least one of the engaging member and the contacts is configured such that the moving contact will be engaged and moved by the engaging member out of contact from a predetermined first of the fixed contacts earlier than the second fixed contact.

Preferably, the engaging member is arranged to engage the moving contact at a position on one side of the moving contact about the first spring relatively closer to the first fixed contact than the second fixed contact.

More preferably, the engaging member has a first region arranged to initially engage the moving contact at said position on one side of the moving contact about the first spring relatively closer to the first fixed contact than the second fixed contact, and includes a second region arranged to subsequently engage the moving contact at another position on the opposite side of the moving contact about the first spring.

Further more preferably, the first and second regions lie on a plane which is inclined at a small angle relative to the two fixed contacts.

Yet further more preferably, the first and second regions are provided by a flat surface of the engaging member on said plane.

It is preferred that the moving contact has a straight body.

In a preferred embodiment, the actuating mechanism includes a first actuating member for manual movement and a second actuating member comprising the engaging member and movable by the first actuating member via the second spring past a maximum strain condition thereof to perform said instant spring-release action.

More preferably, the first and second actuating members comprise separate sliders.

Further more preferably, the first and second actuating members are slidable linearly in parallel directions.

It is further preferred that the second spring comprises a compression coil spring co-acting between the first and the second actuating members, with said maximum strain condition being the condition of the coil spring at shortest length.

Preferably, the electrical switch includes a contact separator provided adjacent to the moving contact and movable by the actuating mechanism, upon the actuating mechanism operating towards the first operating condition, to engage and move the moving contact away from the fixed contacts.

More preferably, the separator comprises a pivotable lever.

Further more preferably, the separator has one end engageable and movable by the actuating mechanism and an opposite end for in turn engaging and moving the moving contact.

The electrical switch is preferably a normally-open pushbutton switch.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
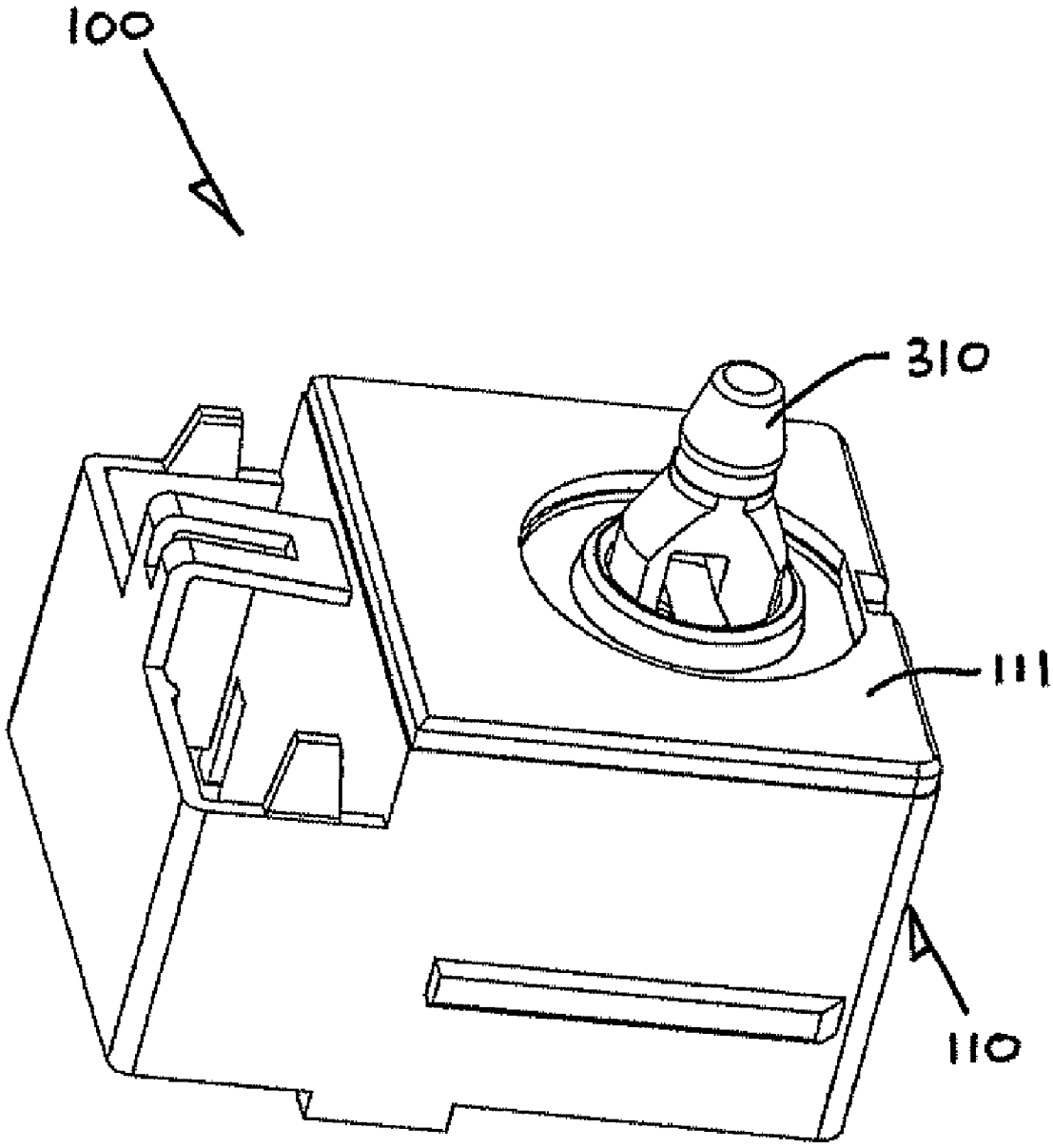
FIG. 1 is a perspective view of an embodiment of an electrical switch in accordance with the invention.
Figure 2:
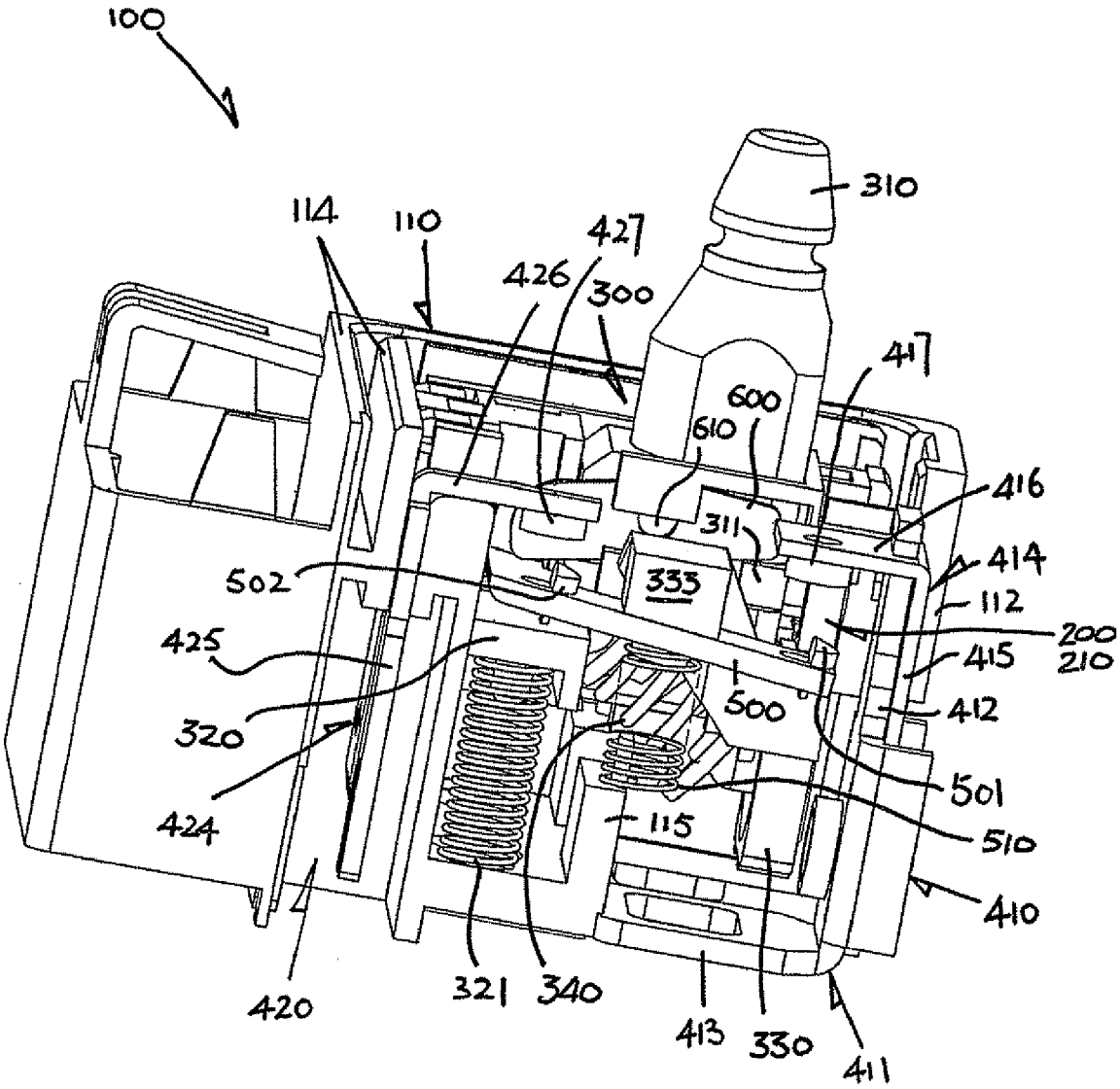
FIG. 2 is a partially-broken perspective view showing certain internal components of the switch of FIG. 1.
Figure 3:
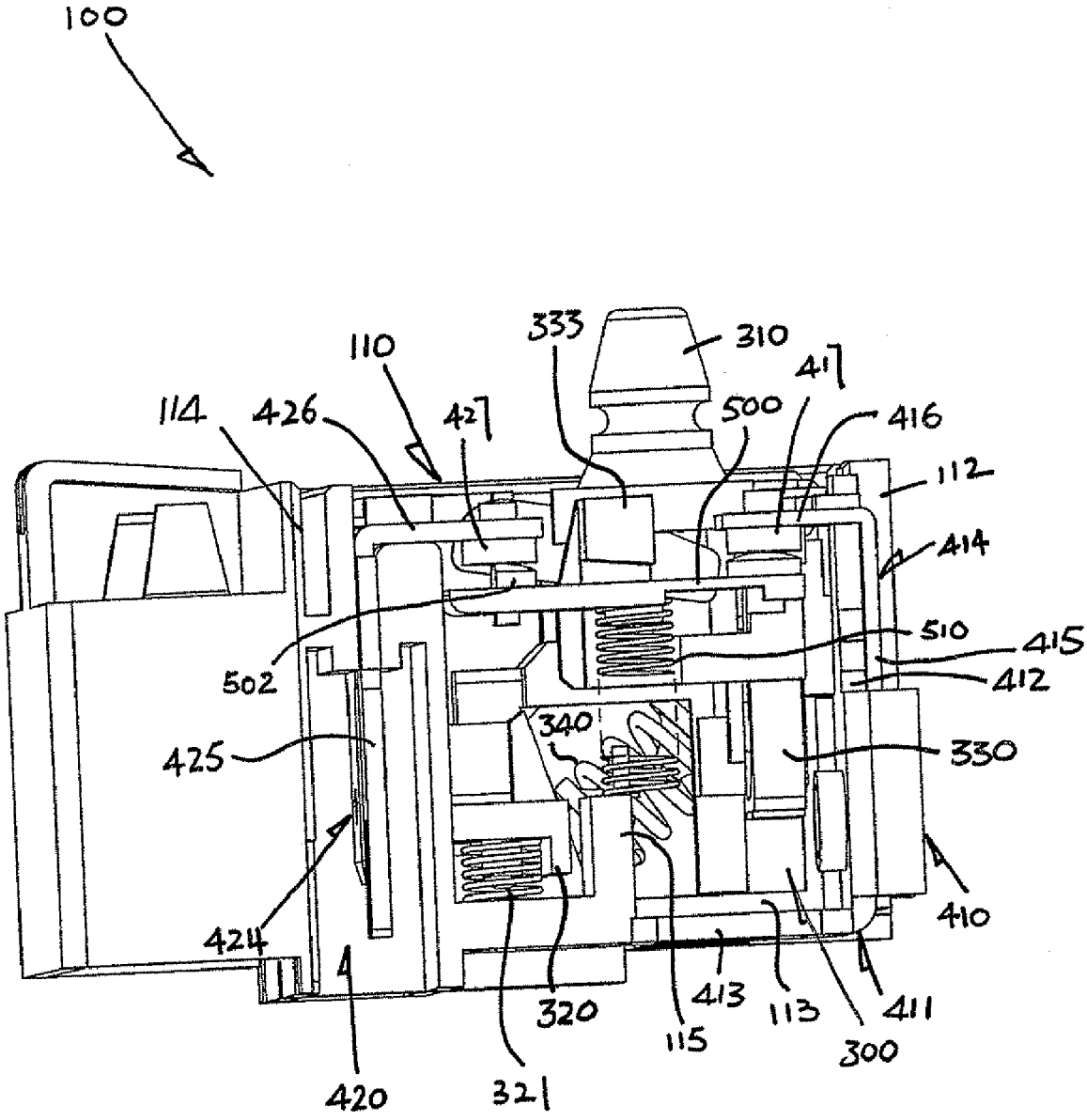
FIG. 3 is a side view of the switch of FIG. 2.

Referring to the drawings, there is shown an electrical switch in the form of a pushbutton switch 100 embodying the invention. The switch 100 includes a cuboidal plastic casing 110 which has an open top side sealed by a lid 111 and houses a pair of switching mechanisms 210 and a central press actuator 310 therefor. Each mechanism 210 involves a pair of switch terminals 410 and 420 and a moving contact lever 500 for making and breaking electrical connection between the two terminals 410 and 420, together constituting a switch unit 200. The terminals 410 and 420 are located on opposite right and left sides of the casing 110, and the contact lever 500 inside the casing 110.

The two switch units 200 are operated by the actuator 310 in tandem. They are arranged on opposite left and right sides of the actuator 310, having practically the same construction but arranged as mirror images of each other. Only one switch unit 200 is shown in the drawings and described herein for clarity.

The right terminal 410 is formed by two, lower and upper L-shaped copper strips 411 and 414, with the lower strip 411 situated upright and the upper strip 414 inverted, having respective vertical limbs 412 and 415 overlapped in contact alongside a right side wall 112 of the casing 110. A horizontal bottom limb 413 of the lower strip 411 extends and underlies a casing bottom wall 113 for connection of an electric cable for example. A horizontal top limb 416 of the upper strip 414 overhangs inside the casing 110, at the free end of which there is mounted a fixed contact pad 417.

The left terminal 420 is formed by a single inverted L-shaped copper strip 424, which has a vertical limb 425 alongside a left side wall 114 of the casing 110 and a horizontal top limb 426 overhanging inside the casing 110. The bottom end of the vertical limb 425 is exposed for connection of an electric cable for example. A fixed contact pad 427 is mounted at the free end of the top limb 426, at the same horizontal level as the other contact 417.

The contact lever 500 has a straight body provided by a straight copper strip that extends generally horizontally, having opposite ends bearing respective contact pads 501 and 502 which are aligned with the aforesaid fixed contacts 417 and 427 respectively for contact making therewith or contact breaking therefrom to perform switching. A vertical compression coil spring 510 acts upon the contact lever 500 at mid-length thereof, from a fixed support 115 of the casing 110, such that the contact lever 500 is resiliently biased upwardly towards the fixed contacts 417 and 427.

The actuator 310 is part of an actuating mechanism 300 inside the casing 110, which includes a first vertical slider 320 integrally formed with the actuator 310 on the left side of the casing 110, and a separate second vertical slider 330 on the right casing side. The actuator 310 is resiliently biased upwards to stay normally uppermost, i.e. while not being pressed (FIG. 4), by a compression coil spring 321 that acts upon the first slider 320 from below. Thus, the first slider 320 also normally stays uppermost.

There is a relatively strong coil spring 340 which is compressed, extending at an acute angle, between the two sliders 320 and 330. Opposite ends of the spring 340 engage respective lateral projections 322 and 332 of the sliders 320 and 330 via individual pivoting bearings 342 and 343. The spring 340 co-acts between the sliders 320 and 330 to resiliently force them apart such that they tend to slide and stay at opposite uppermost and lowermost positions. Consequently, the second slider 330 normally stays lowermost (FIG. 4).

In such a normal operating condition of the actuating mechanism 300, while in the lowermost position, the second slider 330 engages upon the contact lever 500 from above by means of an integral hook 333 thereof situated right over the contact lever 500, at mid-length thereof. The hook 333 is provided by a thickened portion of a top end of the second slider 330, having a slightly inclined flat surface 334 engaging the contact lever 500 such that the contact lever 500 is retained downwardly, against the action of the spring 510, at a correspondingly inclined position (FIG. 4).

Figure 4:
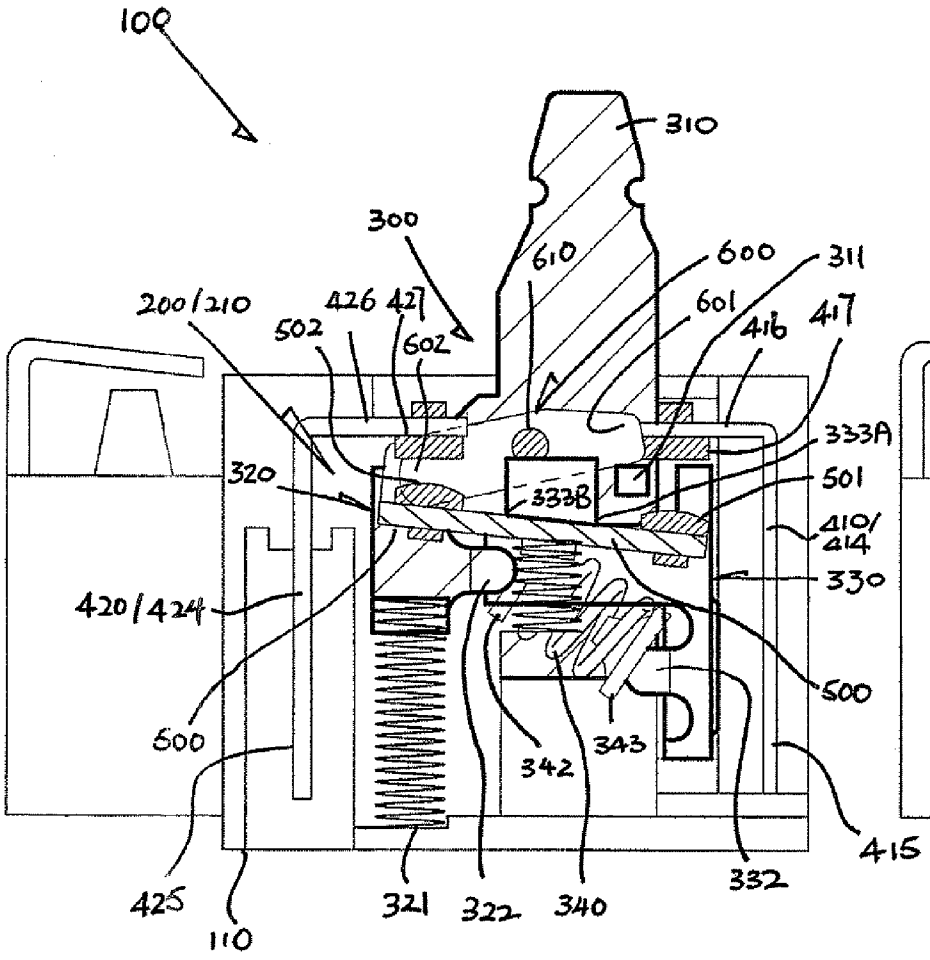
FIG. 4 is a simplified side view corresponding to FIG. 3, showing the switch in an open condition.

The subject switch 100 is thus normally-open, in that the contact lever 500 is retained at a slightly inclined position by the second slider 330, counteracting the spring 510, from contacting the fixed contacts 417 and 427 or short-circuiting the switch terminals 410 and 420 (FIG. 4).

Figure 5:
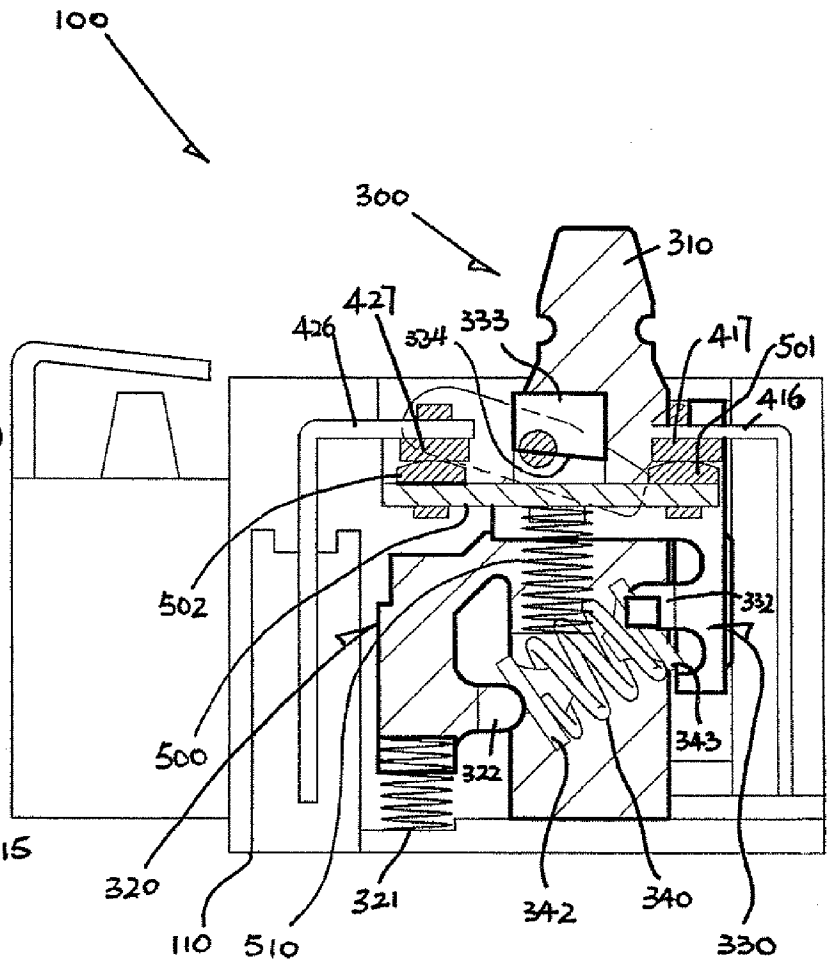
FIG. 5 is a simplified side view similar to FIG. 4, showing the switch in a closed condition.

In operation, during pressing of the actuator 310 (from FIG. 4), upon sufficient lowering of the first slider 320 causing the spring 340 to pivot, or bend, past its shortest length condition in the horizontal position i.e. maximum strain condition, the spring 340 is instantly released and hence flicks the second slider 330 upwards to its uppermost position (FIG. 5).

Given that the second slider 330 will move upwards with its hook 333 beyond the fixed contacts 417 and 427, the contact lever 500 will follow the hook 333 to rise under the action of its own spring 510. The lever 500 will first move into contact with the left fixed contact 417 and then turn horizontal to engage the right fixed contact 427, thereby completing the electrical circuit across the terminals 410 and 420.

The subject switch 100 is then closed in this alternative operating condition of the actuating mechanism 300, temporarily for as long as the actuator 310 remains depressed.

On release of the actuator 310 (from FIG. 5), upon rising of the first slider 320 (by the spring 321) pivoting, or bending, the spring 340 past its shortest length condition in the horizontal position i.e. maximum strain condition, the spring 340 is instantly released and hence flicks the second slider 330 downwards back to its original lowermost position (FIG. 4). En route to the lowermost position, the second slider 330 has its hook 333 hit and pull the contact lever 500 downwardly, against the action of the spring 510, away from the fixed contacts 417 and 427, whereby the subject switch 100 is re-opened.

With its planar surface 334 inclined at a small angle of about 3° to 5° from horizontal, the hook 333 has a bottom right corner 333A that is slightly lower than a bottom left corner 333B thereof, on opposite sides about the axis of the lever spring 510. During switch opening, the right corner 333A will initially engage the contact lever 500 at one position on the right side about the spring 510, with the left corner 333B subsequently engaging the contact lever 500 at another position on the opposite left side about the spring 510.

As the contact lever 500 is initially engaged on the right side of the axis of its supporting spring 510, it will first be pivoted clockwise about the left fixed contact 427, thereby coming out of contact from the right fixed contact 417 first. On continual pivoting, the contact lever 500 will lie flat against the hook surface 334 and be further pressed downwards at the inclined position to also break away from the left fixed contact 427.

This arrangement ensures that the contact lever 500 will make contact with the left fixed contact 427 first, and more importantly to break contact from the other, right fixed contact 417 first. It is therefore possible to make only the right fixed contact pad 417 and the associated contact pad 501 of the lever 500 more robust to withstand contact arcing and/or flashover that are inevitable, thereby rendering the switching action weld-safe and/or non-tease.

The surface 334 of the actuator hook 333 inclined relative to the two fixed contacts 417 and 427 ensures that the contact lever 500 makes contact with and, more importantly, breaks contact from the fixed contacts 417 and 427 at different moments in time. The same result can be achieved in several other ways that can be taken instead or concurrently, for example by inclining the two fixed contacts (i.e. located at different levels) relative to the contact lever, or using a slightly folded or angled contact lever to incline its opposite end contact pads relative to the fixed contacts.

The aforesaid flicking of the second slider 330 by the first slider 320 or the actuator 310 via the spring 340 upon release is rapid and ensures instant contact making and, in particular, contact breaking to alleviate the problem associated with contact arcing and/or flashover.

For double precaution, the subject switch 100 includes a contact separator in the form of a plastic lever 600 for actively separating the contact lever 500 from the fixed contacts 417 and 427. The separator 600 is supported at mid-length by a hinge pin 610 located in the casing 110, for limited pivotal movement.

Opposite ends 601 and 602 of the separator 600 are positioned above a side projection 311 of the actuator 310 and the left end of the contact lever 500 (adjacent to the left contact pad 502) respectively. Upon rising of the actuator 310 on release, its projection 311 hits the right end 601 of the separator 600 from below to thereby pivot the other end 602 downwards, which in turn hits the contact lever 500 (at its left end) from above to assist or ensure separation of the contact lever 500 from the fixed contacts 417 and 427.

In general, the subject electrical switch may not need to be a pushbutton switch and can be, for example, a rocker or toggle switch. It is also not necessarily a normally-open switch.

The invention has been given by way of example only, and various other modifications of and/or alterations to the described embodiment may be made by persons skilled in the art without departing from the scope of the invention as specified in the appended claims.

What is claimed is:

1. An electrical switch comprising:

a casing;

two fixed contacts and a moving conductor located in the casing, the moving conductor moving between a separated position, in which the moving conductor is separated from the two fixed contacts, and a contacting position, in which the moving conductor contacts the two fixed contacts;

a first spring resiliently biasing the moving conductor towards the contacting position to close the switch;

an actuating member including a first fixture and moving upon manual operation of the switch;

an engaging member movable between a release position, released from the moving conductor, and an engaged position, engaging and retaining the moving conductor in the separated position, the engaging member including a second fixture;

a second spring attached to the first and second fixtures so that movement of the actuating member against a bias applied by the first spring moves the engaging member from the engaged position to the released position by an spring-release action, and at least one of the engaging member and the two fixed contacts are arranged so that the moving conductor is engaged and moved by the engaging member out of contact with a first of the two fixed contacts earlier than the moving conductor is moved out of contact with a second of the two fixed contacts; and a contact separator moved by the actuating member to separate the moving conductor from the two fixed contacts, independent of movement of the engaging member.

2. The electrical switch as claimed in claim 1, wherein the engaging member initially engages the moving conductor at a first position, offset from an axis of the first spring and closer to the first of the two fixed contacts than to the second of the two fixed contacts.

3. The electrical switch as claimed in claim 2, wherein the engaging member has a first region arranged to engage the moving conductor, initially, at the first position, and includes a second region arranged to engage the moving conductor, subsequently, at a second position on an opposite side of the axis of the first spring from the first region.

4. The electrical switch as claimed in claim 3, wherein the first and second regions lie in a first plane which is inclined at an angle relative to an imaginary second plane abutting the two fixed contacts.

5. The electrical switch as claimed in claim 1, wherein the moving conductor includes a straight body.

6. The electrical switch as claimed in claim 1, wherein the engaging member is movable by the actuating member via the second spring past a maximum strain condition of the second spring to perform the spring-release action.

7. The electrical switch as claimed in claim 6, wherein the actuating member and the engaging member comprise separate sliders.

8. The electrical switch as claimed in claim 7, wherein the actuating member and the engaging member are slidable linearly, in parallel directions.

9. The electrical switch as claimed in claim 7, wherein the second spring comprises a compression coil spring with the maximum strain condition being compression of the coil spring to a shortest length.

10. The electrical switch as claimed in claim 1, wherein the electrical switch is a normally-open switch and the actuating member comprises an actuable pushbutton.

11. The electrical switch as claimed in claim 1, wherein the actuating member includes a first abutment, the contact separator includes an abutment-engaging surface and a conductor-engaging surface for engaging the abutment and the moving conductor, respectively, and the first spring urges the abutment to engage the abutment-engaging surface so the conductor-engaging surface engages the moving conductor and separates the moving conductor from the two fixed contacts.

12. The electrical switch as claimed in claim 11, further comprising a pivot connecting the contact separator to the casing.

13. The electrical switch as claimed in claim 12, wherein the abutment-engaging surface and the conductor-engaging surface are disposed at opposing ends of the contact separator and on opposite sides of the pivot.

* * * * *